US006431889B1

(12) United States Patent
Olson

(10) Patent No.: US 6,431,889 B1
(45) **Date of Patent: *Aug. 13, 2002**

(54) HIGH DENSITY EDGE CARD CONNECTOR

(75) Inventor: Stanley W. Olson, East Berlin, PA (US)

(73) Assignee: Berg Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/200,114

(22) Filed: Nov. 25, 1998

Related U.S. Application Data

(60) Provisional application No. 60/068,664, filed on Dec. 23, 1997.

(51) Int. Cl.[7] ..... H01R 13/62

(52) U.S. Cl. ..... 439/157; 439/634

(58) Field of Search ..... 439/157, 325, 439/327, 328, 629, 630, 631, 634, 636, 637, 60, 59, 160, 152, 153, 155, 159, 720, 751, 733.1, 741

(56) References Cited

U.S. PATENT DOCUMENTS

| | | | | | |
|---|---|---|---|---|---|
| 4,586,254 | A | * | 5/1986 | Ammon et al. | 29/884 |
| 5,122,078 | A | * | 6/1992 | Davis et al. | 439/405 |
| 5,395,250 | A | | 3/1995 | Englert, Jr. et al. | 439/65 |
| 5,468,154 | A | * | 11/1995 | Yip et al. | 439/79 |
| 5,470,240 | A | * | 11/1995 | Suzuki | 439/157 |
| 5,554,047 | A | * | 9/1996 | Englert, Jr. | 439/405 |
| 5,558,528 | A | * | 9/1996 | Cheng et al. | 439/160 |
| 5,593,322 | A | * | 1/1997 | Swamy et al. | 439/660 |
| 5,609,493 | A | * | 3/1997 | Cheng et al. | 439/157 |
| 5,782,644 | A | * | 7/1998 | Kiat | 439/79 |
| 5,993,235 | A | * | 11/1999 | Chen | 439/326 |
| 6,024,584 | A | * | 2/2000 | Lemke et al. | 439/83 |
| 6,116,921 | A | * | 9/2000 | Scholz et al. | 439/83 |

FOREIGN PATENT DOCUMENTS

| | | |
|---|---|---|
| EP | 0 312 182 | 4/1989 |
| EP | 0 676 833 A2 | 10/1995 |
| EP | 0 784 359 A1 | 7/1997 |
| EP | 0 843 383 A2 | 5/1998 |
| WO | 97/08782 | 3/1997 |

OTHER PUBLICATIONS

European Search Report dated Apr. 1, 1999 for application number EP 98 12 4409.

* cited by examiner

*Primary Examiner*—P. Austin Bradley
*Assistant Examiner*—Ross Gushi
(74) *Attorney, Agent, or Firm*—Perman & Green, LLP

(57) ABSTRACT

An electrical connector comprising: an insulative housing having at least one cavity; a retaining member removably securable to the insulative housing and occluding at least a portion of the cavity, the retaining member having at least one aperture in communication with the cavity; a conductive terminal having a first portion disposed in the cavity and a second portion disposed in the aperture; and a surface mount element mounted on the second portion of the terminal. The member retains the terminal within the insulative housing. A method of making an electrical connector comprising the steps of: inserting the terminal into the cavity; attaching the retaining member to the insulative housing, wherein the mounting portion of the terminal resides within the aperture; and securing the surface mount element to the mounting portion of the terminal.

8 Claims, 12 Drawing Sheets

HIGH DENSITY EDGE CARD CONNECTOR

CROSS-REFERENCE TO RELATED APPLICATIONS

This application claims the benefit of U.S. Provisional Patent Application No. 60/068,664, filed on Dec. 23, 1997 and herein incorporated by reference.

BACKGROUND OF THE INVENTION

1. Field of the Invention

The present invention relates to electrical connectors. More specifically, the present invention relates to high density edge card connectors.

2. Brief Description of Earlier Developments

Edge card connectors have been used for a substantial period of time. As with many other connector types, there has been a continual evolution of these connectors in terms of size reduction, terminal pitch, and electrical performance. In order to reduce the size of the connector and in many cases increase the signal density, it is necessary to decrease the terminal pitch.

The decrease in terminal pitch necessitates a decrease in the amount of insulative material between terminals, thereby resulting in very thin walls between terminals. The insertion of terminals into the terminal cavities can result in rupturing these thin walls between terminal cavities. Also an accumulation of stress along the lengthwise dimension of the connector can occur. However, the decreased wall thicknesses in the connector housing render the housing less able to resist the stress accumulation. As a result, the connector tends to bow. This adversely affects conformance of the connector to the circuit board on which it is mounted and creates alignment difficulties, particularly in surface mount connectors, with contact pads on the printed circuit board.

In addition, many prior designs employ relatively long length contact arms in order to develop sufficient deflection to accommodate daughter board thickness tolerances and to obtain good contact normal forces between the contacts and the terminals of the connector. This increases the impedance of the connector and can unduly increase skew.

SUMMARY OF THE INVENTION

It is an object of the present invention to minimize the accumulation of stresses in the connector housing.

It is a further object of the present invention to employ relatively light retention forces when inserting terminals into the housing.

It is a further object of the present invention to utilize an element secured to the housing after terminal insertion to hold the terminals in place within the housing.

It is a further object of the present invention to provide terminals having features to help retain the terminal within the insulative housing during handling.

It is a further object of the present invention to provide terminals that are movable with respect to the housing to accommodate differences in the coefficient of thermal expansion (CTE) of the connector body and the printed circuit board upon which the connector mounts.

It is a further object of the present invention to employ deformable elements, such as solder balls, to secure the terminals to the housing.

It is a further object of the present invention to provide a connector that can be closely stacked in an end-to-end configuration with another connector.

These and other objects of the present invention are achieved in one aspect of the present invention by an electrical connector comprising: an insulative housing having at least one cavity; a retaining member removably securable to the insulative housing and occluding at least a portion of the cavity, the retaining member having at least one aperture in communication with the cavity; a conductive terminal having a first portion disposed in the cavity and a second portion disposed in the aperture; and a surface mount element mounted on the second portion of the terminal. The member retains the terminal within the insulative housing.

These and other objects of the present invention are achieved in another aspect of the present invention by a card edge connector, comprising: an insulative housing, a conductive terminal, a retaining member and a surface mount element. The insulative housing has: a slot for receiving an edge of a card; a cavity in communication with the slot and a pair of posts, each having channels in communication with the slot for receiving the card. The conductive terminal has a mating portion residing within the cavity for engaging the card edge and a mounting portion extending from the cavity. The retaining member secures to the insulative housing and has an aperture in communication with the cavity that receives the mounting portion of the terminal. The retaining member preventing the terminal from exiting the cavity. The surface mount element attaches to the mounting portion of the terminal.

These and other objects of the present invention are achieved in another aspect of the present invention by a method of making an electrical connector, comprising the steps of: providing an insulative housing having a cavity; providing a conductive terminal having a mounting portion; providing a retaining member having an aperture; providing a surface mount element; inserting the terminal into the cavity; attaching the retaining member to the insulative housing, wherein the mounting portion of the terminal resides within the aperture; and securing the surface mount element to the mounting portion of the terminal. The retaining member keeps the terminal within the cavity.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

Figure 1:
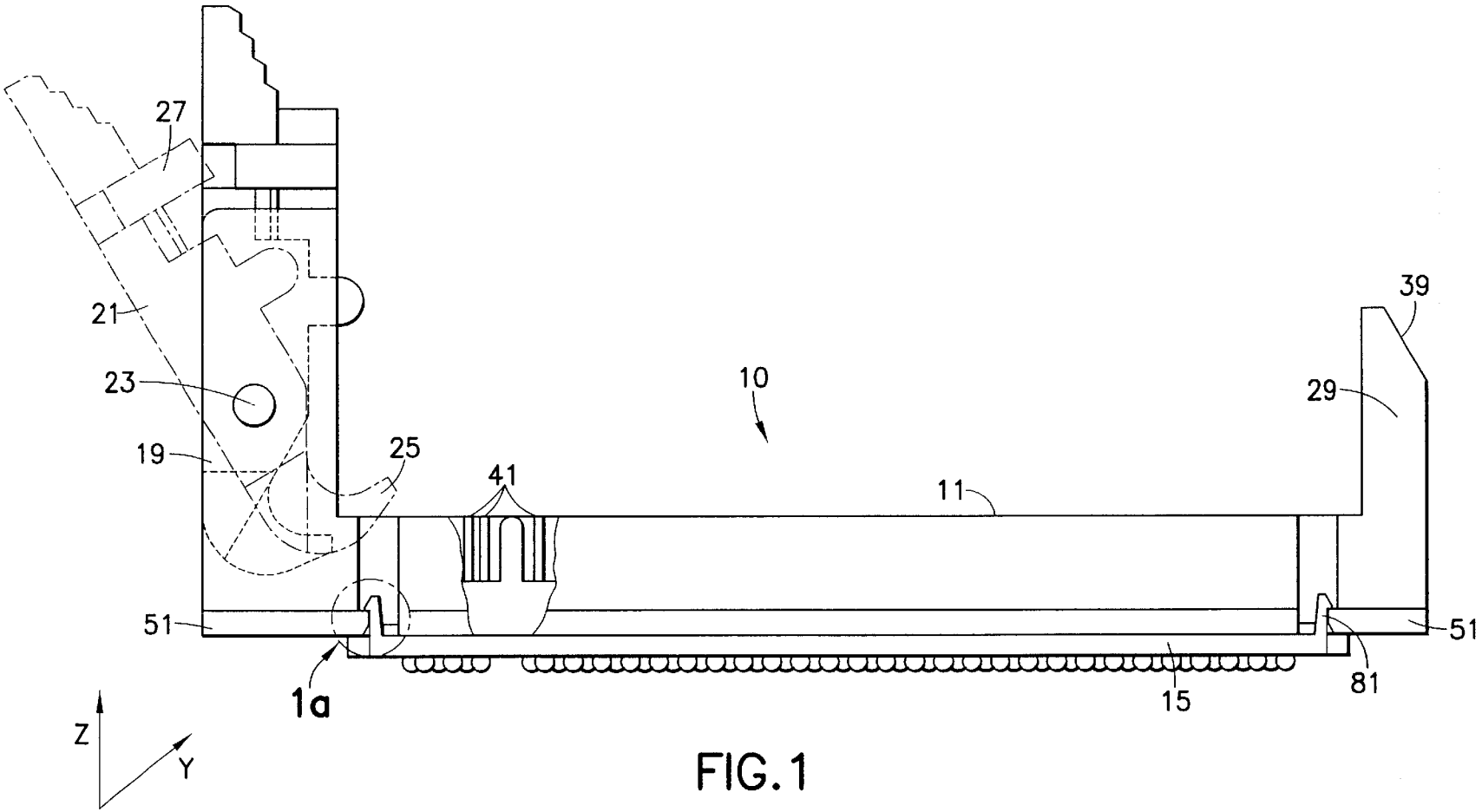
FIG. 1 is a side elevation of a connector embodying the invention.
Figure 1A:
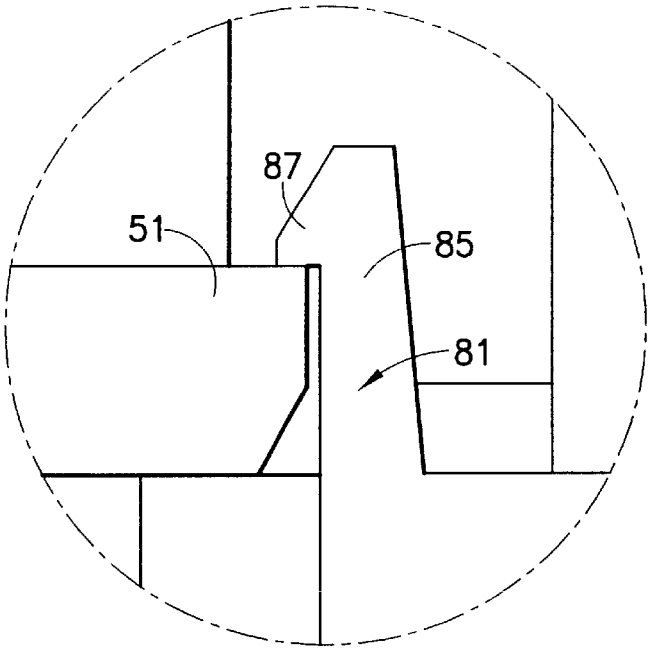
FIG. 1*a* is a detailed view of a portion of FIG. 1.
Figure 6:
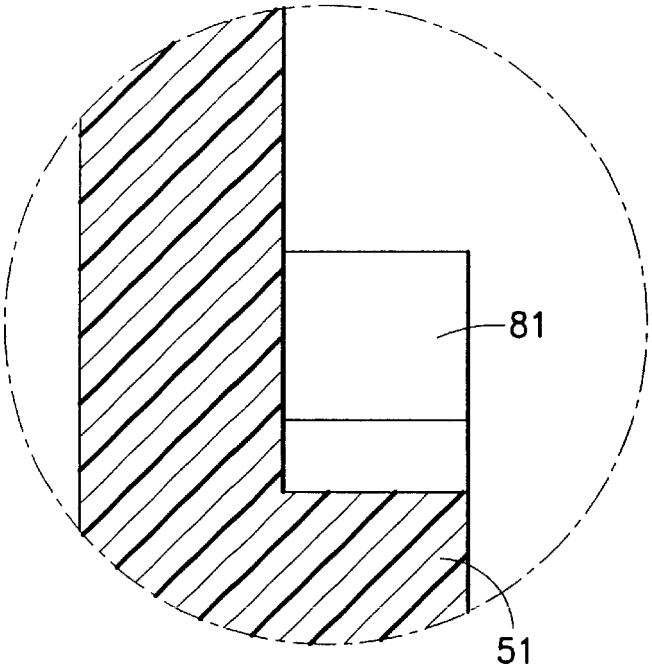
FIG. 6 is a detailed view of a portion of FIG. 3*b* showing another feature of the terminal retention element.
Figure 2:
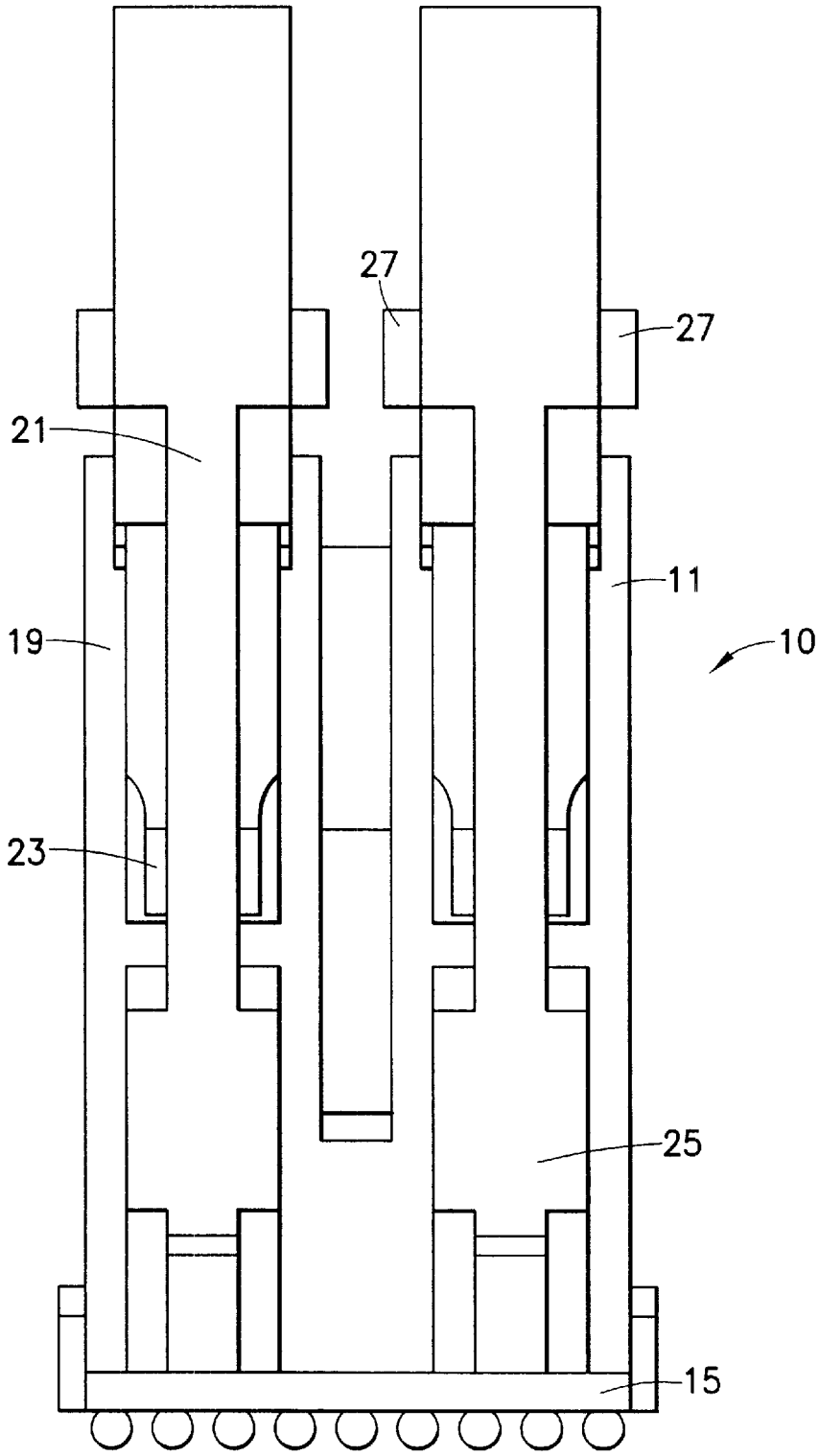
FIG. 2 is an end view of the connector in FIG. 1.
Figure 3:
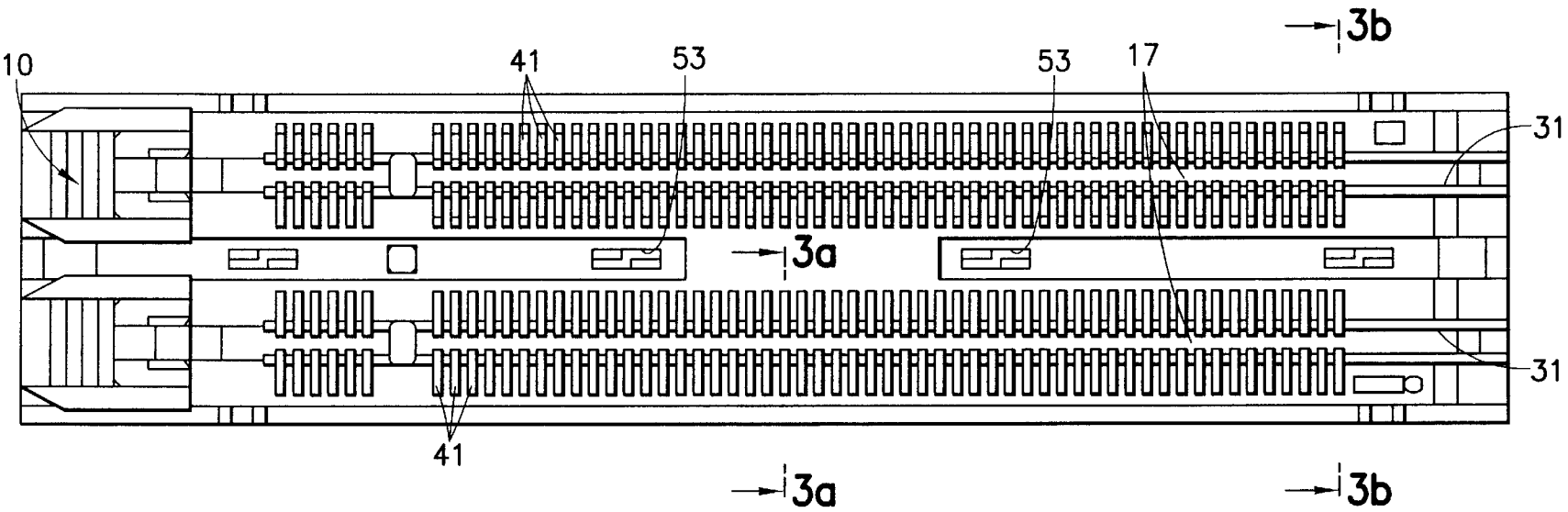
FIG. 3 is a top view of the connector in FIG. 1.
Figure 3A:
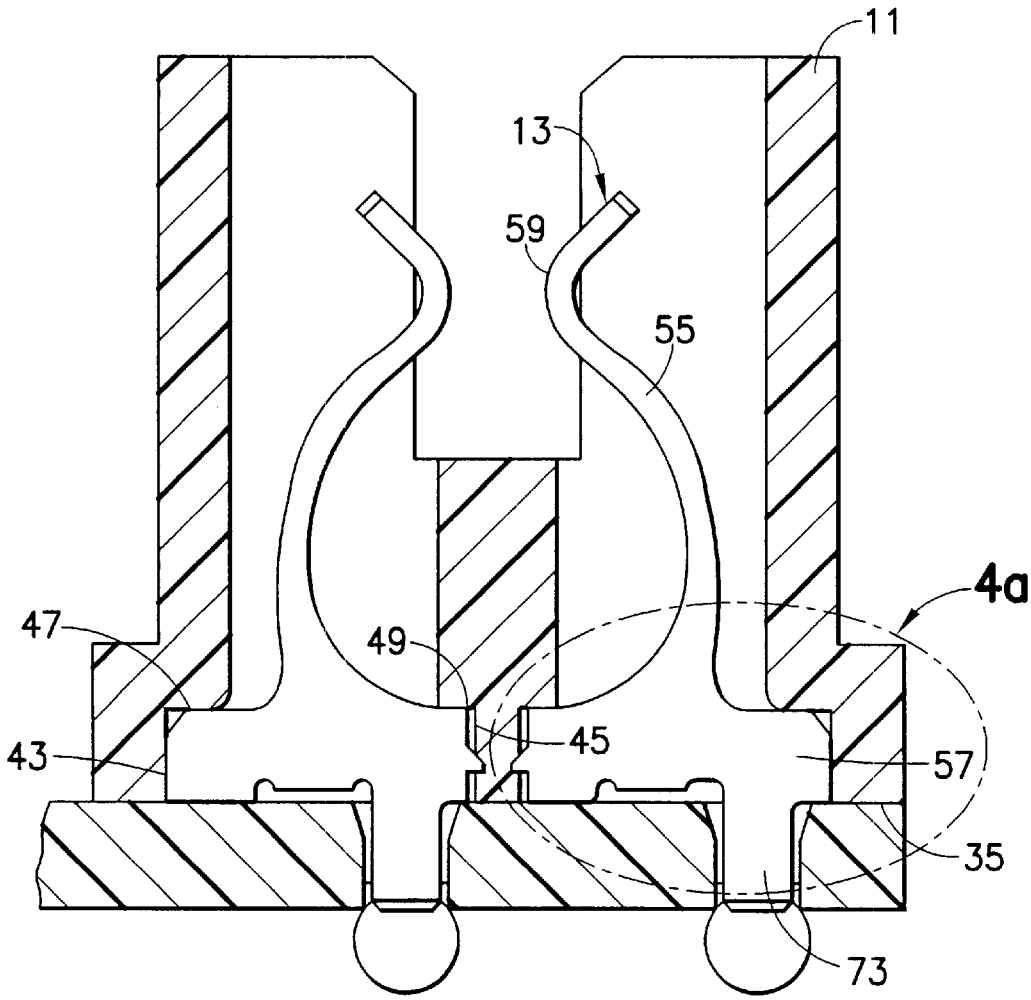
FIG. 3*a* is a cross-sectional view taken along line IIIA—IIIA in FIG. 3 showing the terminals inserted into a main portion of the connector housing.

FIGS. 1–3 show various views of a connector 10 of the present invention. Connector 10 consists of three main components, a main body 11, terminals 13 and a terminal retention member 15. Generally speaking, assembly of connector 10 proceeds by inserting terminals 13 into main body 11, then securing terminal retention member 15 to main body 11 which retains terminals 13 within main body 11. Each component will now be described in detail.

Main body 11 is formed of a suitable dielectric material. Body 11 can have a generally planar base with two parallel, longitudinally oriented slots 17 (see FIG. 3) that receive daughter boards B (see FIG. 7) in an edge-wise configuration.

Body 11 includes upstanding, split guide posts 19 at one end. Guide posts 19 include a latch member 21 pivotally mounted via a pivot pin 23 in each guide post 19. Latch member 21 can pivot between a substantially vertical position (shown in solid lines in FIG. 1) and an ejecting position (shown in phantom in FIG. 1). Latch member 21 includes an ejecting foot 25 at a bottom end and a pair of opposed cam tabs 27 for urging the portions of guide post 19 together against surfaces of inserted daughter board B. International publication number WO 97/08782, herein incorporated by reference, describes in more detail the aforementioned structure for retaining daughter board B in connector 10.

Figure 8:
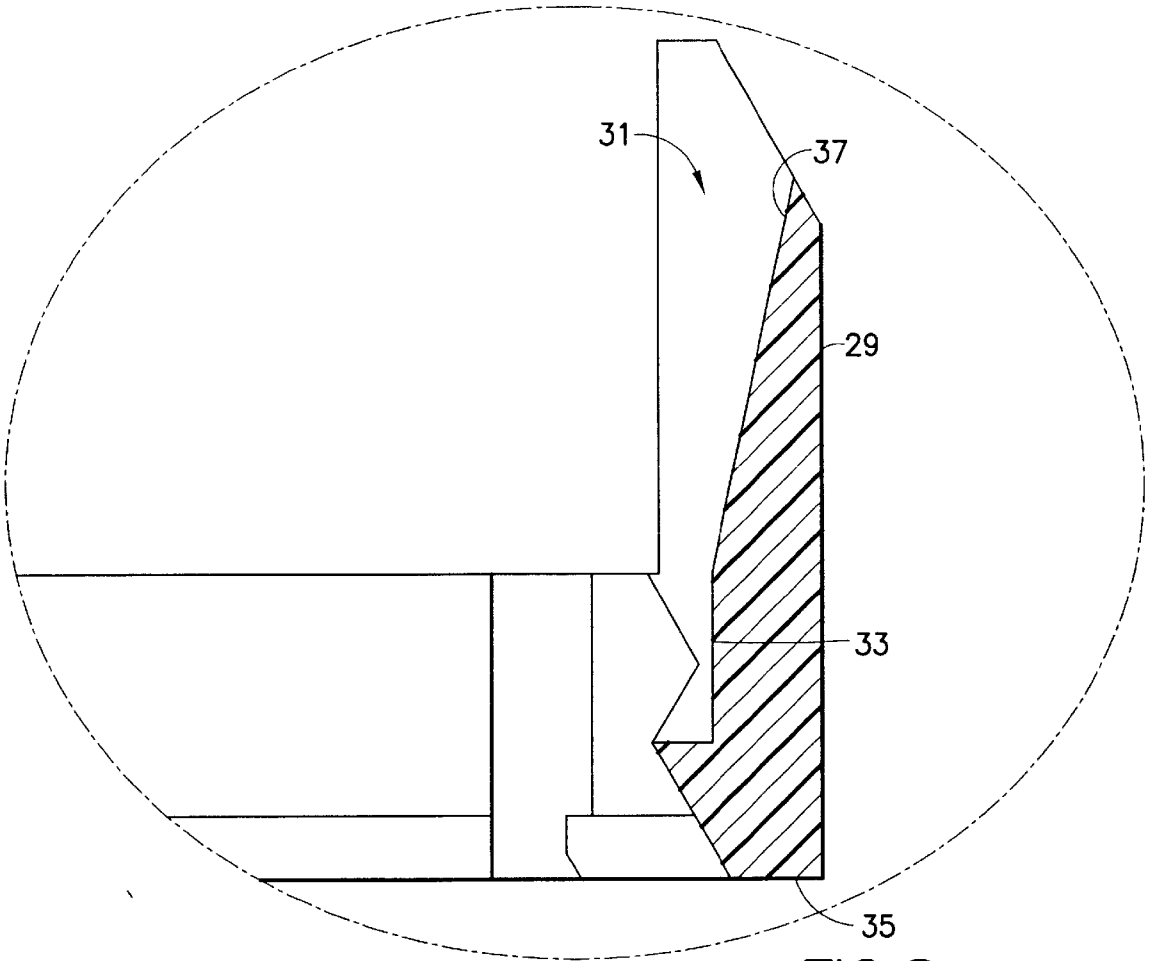
FIG. 8 is a detailed view of a portion of FIG. 7.

Guide posts 29 oppose guide posts 19 on main body 11. Guide posts 29 include a slot 31 aligned with slot 17 in body 11 to receive side edges of inserted daughter board B. As seen in FIG. 8, guide posts 29 have a surface 33 extending generally perpendicular to bottom surface 35 of main body 11 and an angled surface 37. Angled surface 37 acts as a lead-in for inserting daughter board B into connector 10. As will be described in more detail below, surface 33 helps retain daughter board B within connector 10.

Figure 9:
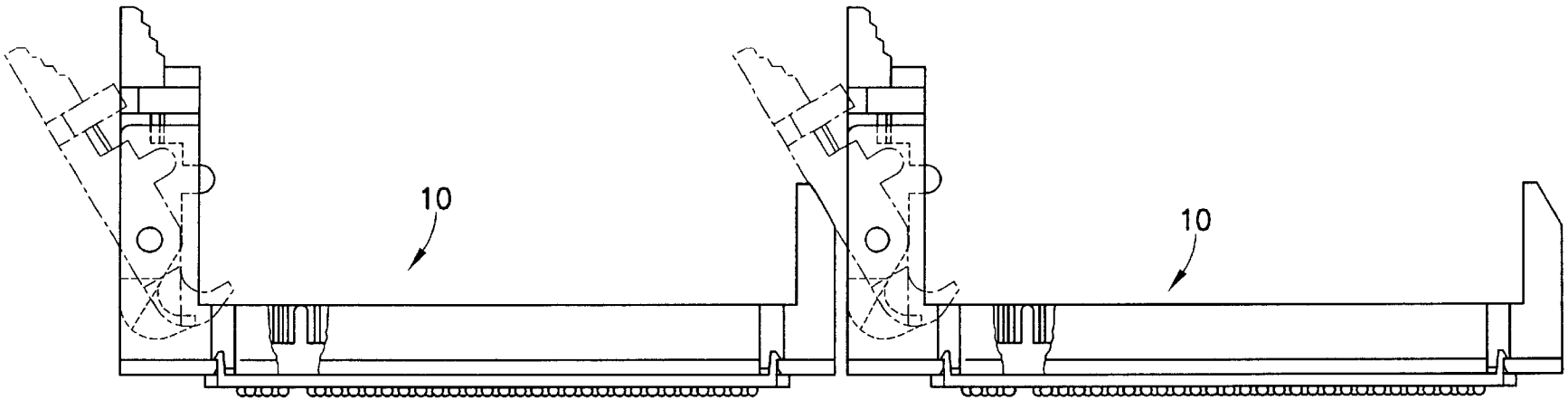
FIG. 9 is a side view of two connectors according to the invention arranged end-to-end.

Preferably, the upper end of each guide post 29 is relieved to form a canted surface 39. This allows end-to-end placement of several connectors 10 as seen in FIG. 9 and as will be described in more detail below.

Referring to FIGS. 1 and 3, a plurality of terminal cavities 41 flank each slot 17 in body 11. Cavities 41 receive a respective terminal 13 that engage contact pads (not shown) disposed along the edge of daughter boards B inserted into slots 17.

Cavities 41 includes side surfaces 43, 45 and upper surfaces 47, 49 that abut against corresponding portions of terminals 13 when terminals 13 reside within main body 11. Surfaces 43, 47, 49 of cavities 41 form datum surfaces for the location of terminals 13 within main body 11. This feature will be described in more detail below.

Main body 11 also includes a plurality of flanges 51 formed on opposed outer surfaces along bottom surface 35. Flanges 51, along with openings 53 in a central portion of main body 11, help secure terminal retention member 15 to main body 11. For example, terminal retention member 15 secures to main body 11 by positioning along bottom surface 35 and securing latch members with flanges 51 and openings 53.

FIGS. 3*a*, 3*b*, 4*a* and 4*b* display terminals 13 positioned within main body 11. Each terminal 13 includes a tapered cantilever beam 55 extending from a base portion 57. Cantilevered beam 55 includes a contact surface 59 at a distal end opposite base portion 57.

Base portion 57 includes side surfaces 61, 63; upper surfaces 65, 67; and lower surface 69 that interact with surfaces 43, 45, 47, 49 of cavities 41 and a mating surface of terminal retention member 15. Interaction of the various surfaces help align and retain terminal 13 within main body 11.

Figure 4A:
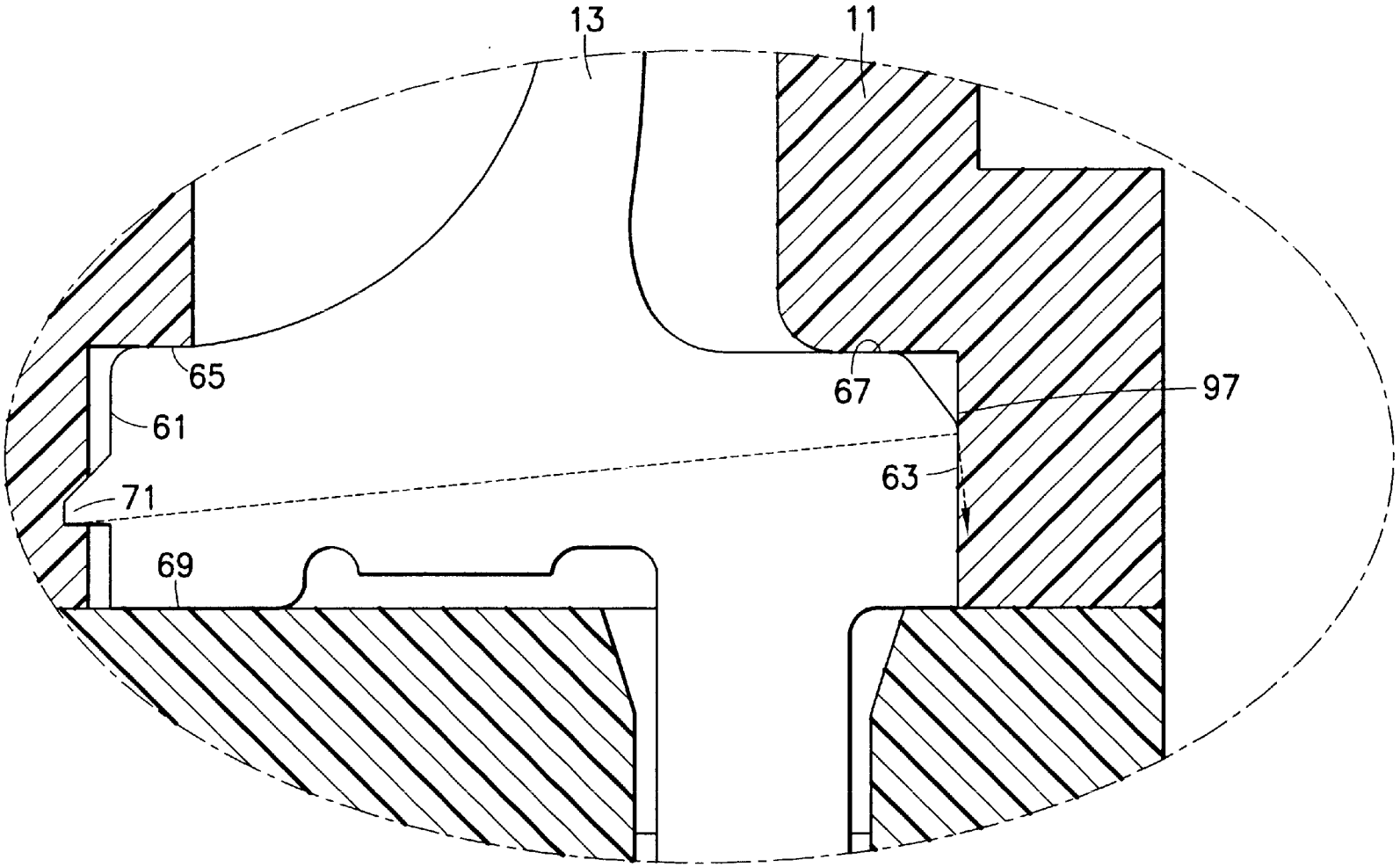
FIG. 4*a* is a detailed view of a portion of FIG. 3*a* showing a terminal retained within the connector.

Side surface 61 has a retention barb 71 extending therefrom. Barb 71 pierces side surface 43 of cavity 41 to retain terminal 13 within main body 11 until terminal retention member 15 can secure to main body 11. FIG. 4*a* displays terminal 13 properly seated within main body 11.

Figure 4B:
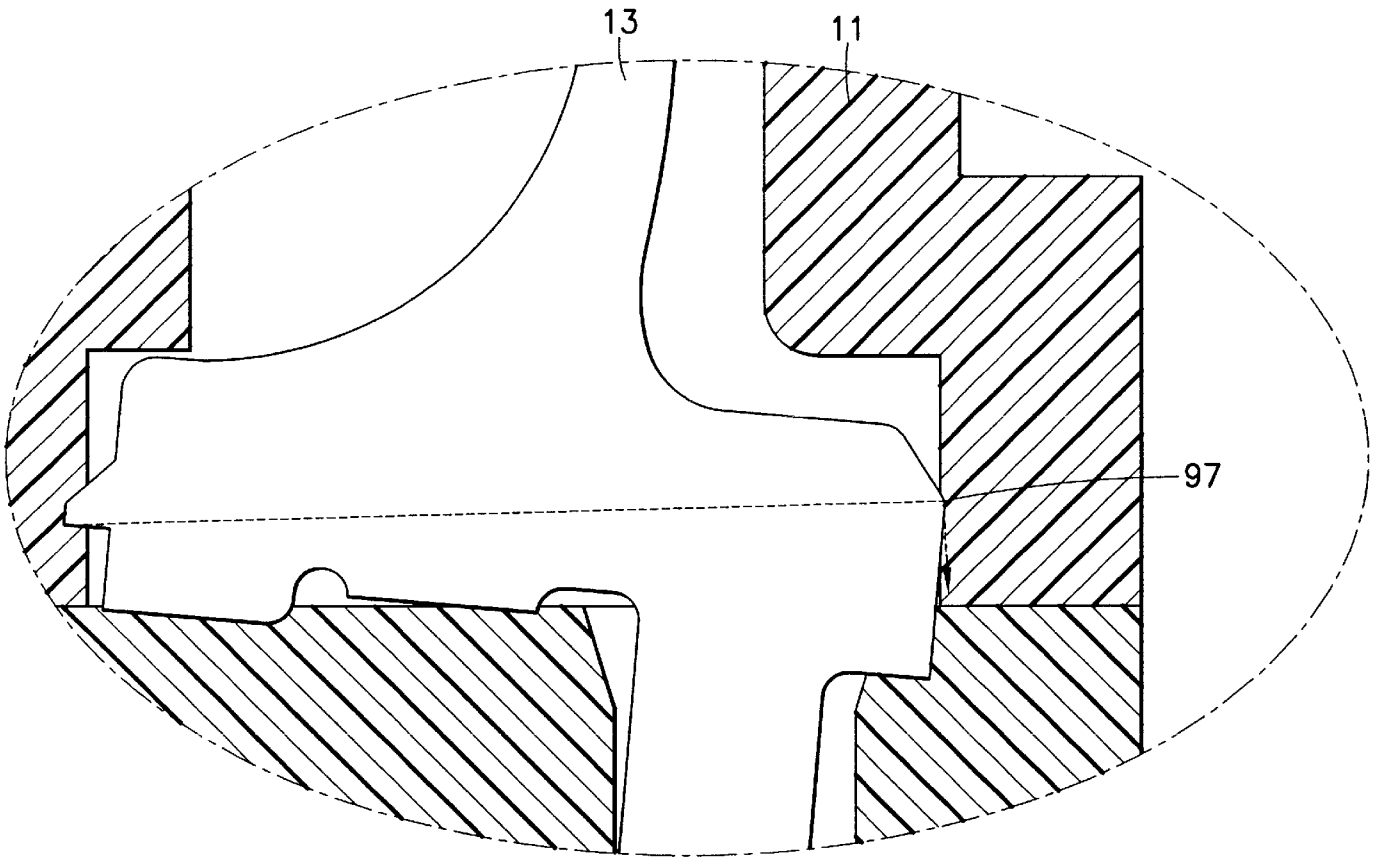
FIG. 4*b* is a detailed view of a portion of FIG. 3*a* showing a terminal partially retracted from the connector housing.
Figure 5:
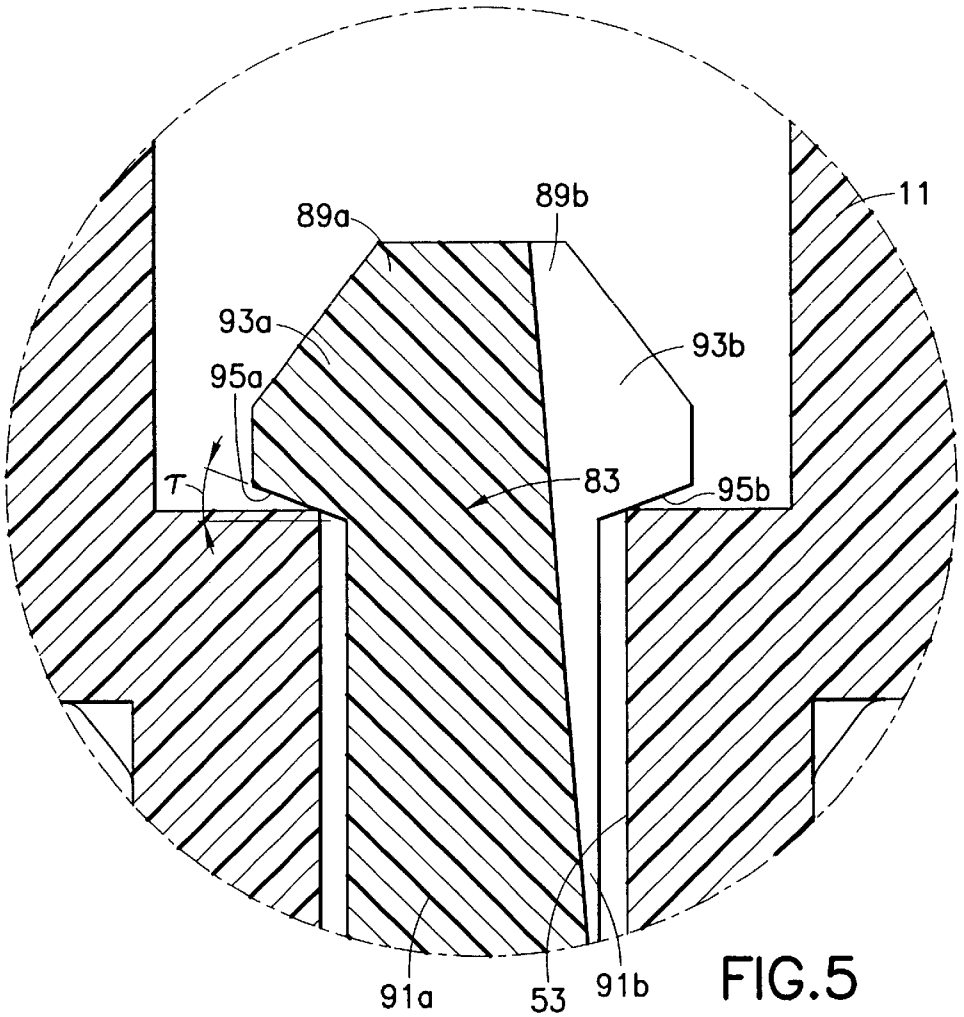
FIG. 5 is a detailed view of a portion of FIG. 3*b* showing a feature of the terminal retention element.

Retention barb 71 is located towards a lower end of side surface 61 to prevent rotation of terminal 13 out of main body 11. By locating barb 71 at a lower end of side surface 61, an upper portion 97 of side surface 63 cannot exit main body 11. As seen in FIG. 4*b*, when terminal 13 rotates, upper portion 97 interferes with side surface 45 of cavity 41. This feature additionally retains terminal 13 within main body 11 until terminal retention member 15 can secure to main body 11.

Base portion 57 also includes a terminal tab 73 to receive, for example, a fusible element 75 such as a solder ball for surface mounting connector 10 to a substrate (not shown). Fusible elements 75 typically have a slightly greater transverse extent than the transverse extent of the openings 79 in terminal retention member 15. Thus, fusible elements 75 also serve a retention function for securing terminals 13 in proper position and for holding terminal retention member 15 onto main body 11. Fusible elements 75 form a connection between the terminals 13 and contact pads on the circuit substrate by conventional reflow techniques.

Fusible elements 75 secure to tabs 73 by applying a solder paste (not shown) into the openings 79, then by placing individual fusible elements 75 over openings 79. After placement of fusible elements 75 in openings 79, connector 10 then undergoes a first reflow operation to melt the solder paste and to fuse the fusible element 75 to tab 73 of terminal 13. A second reflow step attaches connector 10 to substrate S.

Figure 3B:
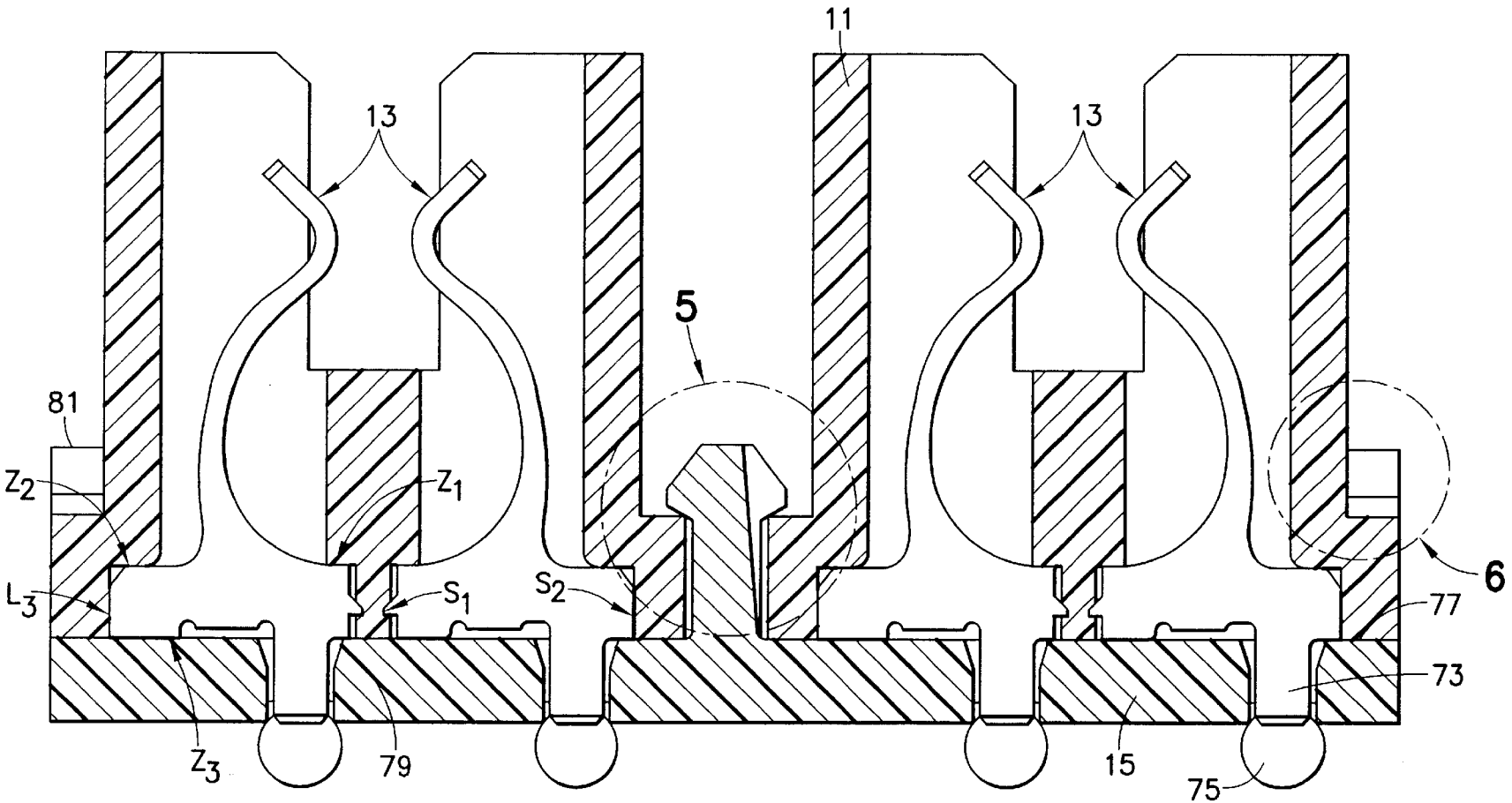
FIG. 3*b* is a cross-sectional view taken along IIIB—IIIB in FIG. 3 showing the terminals secured within the connector housing with a terminal retention element.

FIGS. 1 and 3*b* display terminal retention member 15. Preferably, retention member 15 is made from a molded dielectric material. Retention member 15 includes a mating surface 77 that abuts bottom surface 35 of main body 11 and surfaces 69, 71 of terminal 13. Retention member 15 includes a plurality of apertures 79 sized to receive terminal tab 73 of terminal 13 and at least a portion of fusible element 75. Apertures 79 are preferably larger than tabs 73 to allow longitudinal movement of tab 73 without interference by the walls forming apertures 79.

Terminal retention member 15 includes latches 81 located at opposite ends thereof to engage flanges 43 of main body 11 and centrally located latches 83 to engage openings 53 of main body 11. Latches 81, 83 are preferably cantilevered members integrally molded with terminal retention member 15.

Latches 81 include a flexible arm 85 and a catch 87 that engages flange 43. Latches 83 comprise two pieces 89*a*, 89*b* in an opposed relationship. Each opposed portion 89*a*, 89*b* has a flexible arm 91*a*, 91*b* and a catch 93*a*, 93*b*. Slightly different than catch 87 of latch 81, catches 93*a*, 93*b* each include surfaces 95*a*, 95*b* angled opposite to that of conventional latches. Canted surfaces 95*a*, 95*b* engage opposite edges of opening 53 to retain member 15 in main body 11.

The canting of surfaces 95*a*, 95*b* helps accommodate tolerance variations between main body 11 and terminal retention member 15. The amount of potential tolerance absorption is represented by the dimension T, a dimension that is defined by the difference in elevation between the inside edge of surface 95*a* and the outside edge of surface 95*b*. In essence, surfaces 95*a*, 95*b* serve as a camming surface, under the spring force generated by latches 83 to draw terminal retention member 15 against bottom surface 35 of main body 11. Stated differently, the securing system for the terminal retention member 15 can absorb vertical tolerances between main body 11 and terminal retention member 15 and also the vertical dimension of the base 57 of terminal 13. Preferably, surfaces 95*a*, 95*b* extends approximately 27° from the lateral axis of latch 83.

The assembly of connector 10 will now be described. Initially, main body 11, terminals 13 and terminal retention member 15 are separate elements. The first assembly step inserts terminals 13 into cavities 41 of main body 11. FIG. 4*a* displays terminal 13 properly inserted into cavity 41. When seated within cavity 41, side wall 63 of terminal 13 abuts side surface 43 of cavity 41 and upper surfaces 65, 67 of terminal 13 abut upper surfaces 47, 49 of cavity 41.

The points of contact between cavity 41 and terminal 13 constitute datum points, designated by arrows $Z_1$, $Z_2$ and $L_3$. The datum points help locate terminals 13 within main body 11. Specifically, datum points $Z_1$ and $Z_2$ help position terminals 13 longitudinally within main body 11 (i.e. in the direction extending from the bottom to the top of FIG. 3*b*). Also, datum point $L_3$ helps position terminals 13 laterally within main body 11 (i.e. the direction extending from the left side to the right side of FIG. 3*a*).

As seen in FIG. 4*a*, a clearance exists between side wall 61 (excluding barb 71) of terminal 13 and side surface 43 of cavity 41 when side wall 63 of terminal 13 abuts side surface 45 of cavity 41. The length of barb 71, however, is greater than the clearance between side wall 61 of terminal 13 and side surface 43 of cavity 41. As a result, a portion of barb 71 pierces side surface 43 of cavity 41. Barb 71 allows terminals 13 to move slightly in the longitudinal direction within main body 11 while still engaging side surface 43 of cavity 41. This helps alleviate any stresses that might result from any mismatch in the coefficients of thermal expansion (CTE) between the materials of main body 11 and the substrate, such as a printed circuit board (not shown) on which the connector 10 is mounted.

Barb 71 creates a light retentive force sufficient to hold terminals 13 in housing 11 for subsequent handling prior to the attachment of terminal retention member 15, but not for full retention under conditions of use. The light retentive force applies a relatively light stress to main body 11 at locations $S_1$, $S_2$ than with conventional connectors. The light retentive force does not urge the main body to bow or cause the webs between adjacent cavities to crack as sometimes found with conventional connectors. The contact of surface 63 along surface 43 and the point contact of barb 71 with surface 45 allows for the movement of terminal 13 independent of housing 11.

After terminals 13 are inserted within main body 11, terminal retention portion 15 is secured to main body 11. Specifically, terminal retention portion 15 is positioned to abut lower surface 35 of main body 11. Latches 81, 83 on terminal retention portion engage corresponding flanges 51 and openings 53 on main body 11.

When properly fastened to main body 11, mating surface 77 of terminal retention member 15 abuts lower surface 69 of terminal 13. The point of contact between cavity 41 and terminal 13 constitutes another datum point, designated by arrow $Z_3$ to help locate terminals 13 longitudinally within main body 11.

Figure 7:
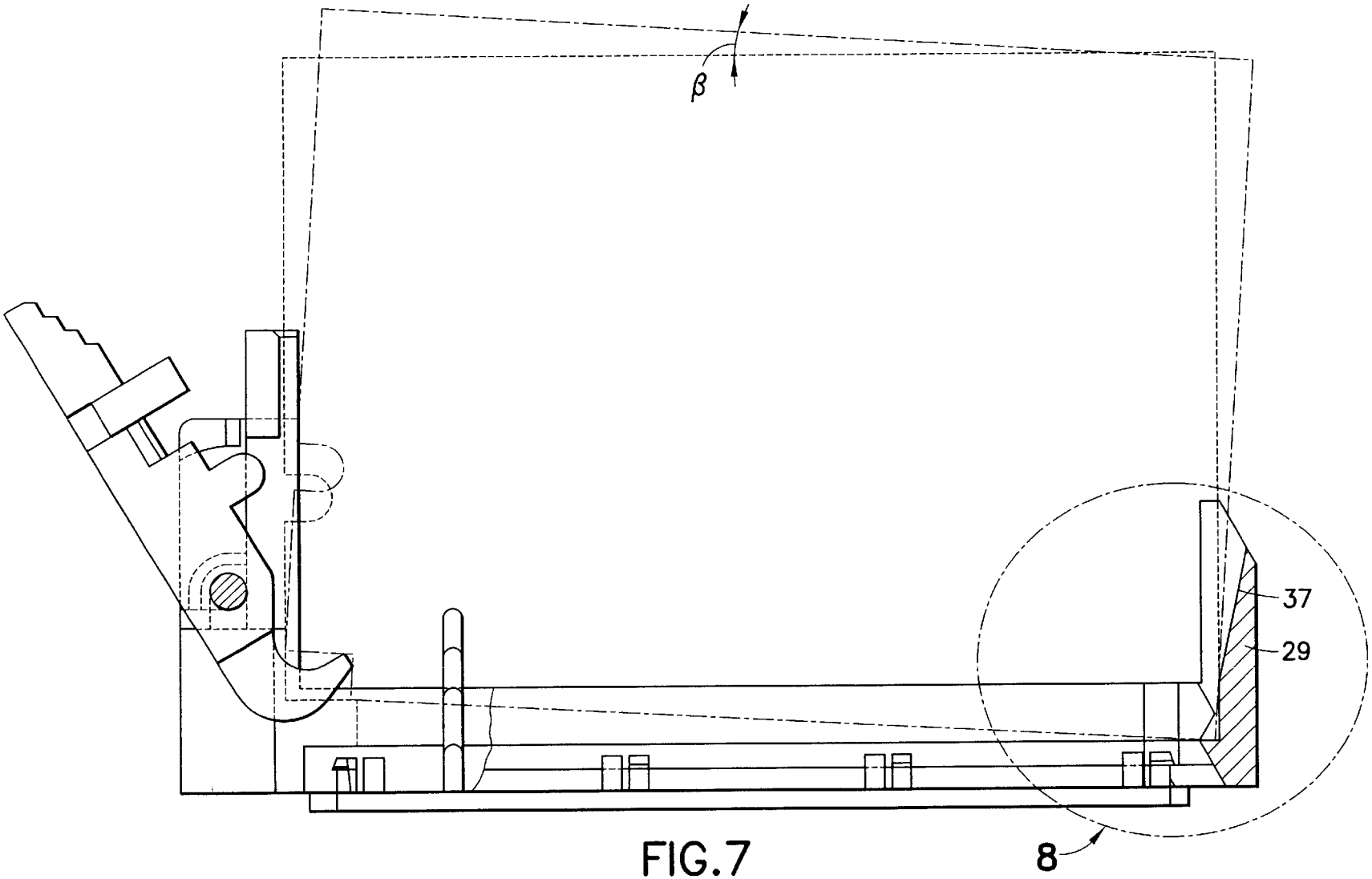
FIG. 7 shows the connector of FIG. 1 together with a mating daughter board.

The assembly of connector 10 is now complete. After assembly, connector 10 is attached to a substrate (not shown) using known surface mount techniques (SMT). Once attached to a substrate, connector 10 can receive daughter boards B as shown in FIG. 7.

Generally perpendicular surface 33 helps retain daughter board B in slot 17. In a manner similar to the arrangement of cavity 41, perpendicular surface 33 inhibits rotation of daughter board B out of slot 17. Upon rotation of daughter board B, the corner of daughter board B would interfere with perpendicular surface 33 as shown by the phantom line in FIG. 8. Only upon actuation of lever 21 can daughter board B pass by perpendicular surface 33.

As seen in FIG. 9, connectors 10 of the present invention can be closely stacked end-to-end. Canted surfaces 39 allow close end-to-end stacking because since they allow sufficient space for the outward swinging of the latch 21 to effect removal of daughter board B.

The advantages of the invention disclosed are many. A high density, fine-pitch connector can be achieved which maintains a reliable and repeatable terminal to insulator interface. Propagation delay through the connector is minimized by employing short electrical paths that have low inductance. The fine pitch connector of the present invention utilizes minimum printed circuit board space. The connector also has higher reliability in severe shock and vibration environments.

The structure as disclosed also allows the terminal to move longitudinally with the printed circuit board under conditions of thermal expansion, without being impeded by CTE differential. The terminal is retained at the ends of its base only and the terminal leg is allowed to follow the expansion and contraction of the printed circuit board relative to the housing, without resistance. This prevents the accumulation of terminal-to-housing stresses and subsequent forces on the solder ball-to-terminal and/or solder ball-to-printed circuit board interface. Manufacturing economies are realized by providing tolerance absorbing securing structures between assembled parts of the housing.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A high-density edge card electrical connector comprising:

an insulative housing having at least two main bodies, each said main body containing a cavity; said main bodies spaced apart by a main body opening;

conductive terminals positioned in each said cavity, and having asymmetric retention sections disposed in said cavity and mounting members depending from said retention sections;

a generally planar terminal retention member attached to said insulative housing and having apertures wherein said mounting members of said terminals reside within said apertures, there being gaps between said apertures and said mounting members, said gap extending around said mounting members; and surface mount elements, said surface mount elements being secured to said mounting members of said terminal at a location within said aperture in said retention member, whereby said retention member keeps said terminal within said cavity;

said generally planar terminal retention member further comprising two cantilevered latches protruding therefrom, extending through said main body opening, and terminating in catches that allow for accommodating tolerance differences between said main body and said terminal retention member.

2. The connector according to claim 1, wherein each of the two cantilevered latches comprises a resiliently flexible arm depending from the generally planar retention member with a corresponding one of the catches being disposed on the resiliently flexible arm.

3. The connector according to claim 1, wherein the catches of the two cantilevered latches engage opposite sides of the main body opening, and wherein each cantilevered latch has a corresponding catch.

4. The connector according to claim 1, wherein one of the two cantilevered latches has a catch on one side, and another of the two cantilevered latches has another catch on another side opposite the catch on the one cantilevered latch.

5. The connector according to claim 1, wherein a first cantilevered latch of the two cantilevered latches has a first catch thereon with a first catch surface, and a second cantilevered latch of the two cantilevered latches has a second catch thereon with a second catch surface, and wherein the first catch surface engages one side of the main body opening and the second catch surface engages an opposite side of the main body opening.

6. The connector according to claim 5, wherein the first catch surface and the second catch surface are canted relative to seating surfaces extending from edges of the main body opening so that when the catches are engaged to the edges of the main body opening the first catch surface and second catch surface form angles with corresponding seating surfaces.

7. The connector according to claim 6, wherein the angle formed between the first catch surface and corresponding seating surface is oriented opposite to the angle formed between the second catch surface and corresponding seating surface.

8. The connector according to claim 1, wherein the main body opening has surfaces with opposing edges which are engaged by the catches of the two cantilevered latches, at least one of the catches having a canted catch surface relative to a direction of insertion of the two cantilevered latches into the main body opening, the catch surface engaging one of the opposing edges wherein the one edge contacts the catch surface at different locations along the catch surface when accommodating different tolerances between the main body and terminal retention member.

* * * * *